US012716243B2

(12) United States Patent
Cho et al.

(10) Patent No.: US 12,716,243 B2
(45) Date of Patent: Aug. 25, 2026

(54) PRECAST CONCRETE STAIRWAY CONSTRUCTION METHOD

(71) Applicant: EASYCORE CO., LTD., Yongin-si (KR)

(72) Inventors: Yeong Cheol Cho, Eumseong-gun (KR); Kwang Joon Yoo, Anyang-si (KR); Byung Min Han, Yongin-si (KR)

(73) Assignee: EASYCORE CO., LTD.

( * ) Notice: Subject to any disclaimer, the term of this patent is extended or adjusted under 35 U.S.C. 154(b) by 237 days.

(21) Appl. No.: 18/294,531

(22) PCT Filed: Oct. 18, 2022

(86) PCT No.: PCT/KR2022/015860
§ 371 (c)(1),
(2) Date: Feb. 1, 2024

(87) PCT Pub. No.: WO2023/085629
PCT Pub. Date: May 19, 2023

(65) Prior Publication Data

US 2024/0344330 A1 Oct. 17, 2024

(30) Foreign Application Priority Data

Nov. 10, 2021 (KR) ..... 10-2021-0153573

(51) Int. Cl.
*E04F 11/02* (2006.01)
*E04F 11/035* (2006.01)

(52) U.S. Cl.
CPC ..... *E04F 11/035* (2013.01); *E04F 2011/0212* (2013.01)

(58) Field of Classification Search
CPC ..... E04F 11/02; E04F 11/0223; E04F 11/035; E04F 11/116; E04F 2011/0212; E04B 1/34; E04B 1/34823; B28B 7/225; E04G 13/06
See application file for complete search history.

(56) References Cited

U.S. PATENT DOCUMENTS 3,281,110 A * 10/1966 Lister ..... B28B 7/225 249/155
3,567,172 A * 3/1971 Peacock ..... B28B 7/225 425/432

(Continued)

FOREIGN PATENT DOCUMENTS

KR 10-2004-0014678 A 2/2004
KR 10-1054450 B1 8/2011

(Continued)

OTHER PUBLICATIONS

Translation of KR 102304397.*

*Primary Examiner* — Jessica L Laux
(74) *Attorney, Agent, or Firm* — NKL Law; Jae Youn Kim

(57) ABSTRACT

Provided relates to a precast-concrete stairway room construction method for constructing a stairway room with one coupling operation by manufacturing the stairway room to have a structure formed by vertically dividing the stairway room into left and right sides, wherein the construction method comprises: a mold preparing step (S10); a rebar arranging step (S20); a concrete placing and curing step (S30); a divided structure manufacturing step (S40); a structure attaching step (S50); and a structure bonding step (S60).

5 Claims, 9 Drawing Sheets

(56) References Cited

U.S. PATENT DOCUMENTS

| | | | | |
|---|---|---|---|---|
| 4,248,020 | A * | 2/1981 | Zielinski | E04B 1/34 52/185 |
| 6,959,521 | B1 * | 11/2005 | Brooks | E04F 11/02 52/745.05 |

FOREIGN PATENT DOCUMENTS

| | | | |
|---|---|---|---|
| KR | 10-1203190 | B1 | 11/2012 |
| KR | 10-2079703 | B1 | 2/2020 |
| KR | 10-2304397 | B1 | 9/2021 |

* cited by examiner

PRECAST CONCRETE STAIRWAY CONSTRUCTION METHOD

TECHNICAL FIELD

The present invention relates to a staircase construction method, and more particularly to a precast concrete staircase construction method of manufacturing two structures formed by vertically dividing a structure of a unit staircase constituting one floor into a left structure and a right structure and enabling construction of the unit staircase by combining the two structures at one time.

BACKGROUND ART

In general, a staircase of a building is formed in such a manner that a foundation (floor) is built first, and then, a formwork is used to form, on top of the foundation, a concrete exterior wall, stairs, and a stair landing that are adjacent to the inner surface of the concrete exterior wall. Further, a step of pouring concrete into the formwork is repeatedly executed to form the exterior wall, the stairs, and the stair landing on every floor.

In this conventional staircase, a formwork is first installed to form a wall, concrete is poured into the formwork, and concrete is left to cure in an appropriate environment. After the concrete is completely cured, the next step is performed. Accordingly, there is a problem in that construction is complicated and it takes a long time to complete construction.

In consideration of the above-described problems, proposed is a method of constructing a staircase using prefabricated precast concrete structures. In this method, a wall, a stair tread, and a stair landing are prefabricated with concrete, and then the prefabricated wall, stair tread, and stair landing are adhesively bonded to each other, thereby constructing the staircase.

However, the above-described related art has the following problems.

In the staircase construction method of the related art, since a staircase is formed of a plurality walls, stair treads, and stair landings, the number of times structures are lifted and adhesively bonded to each other by a crane is relatively increased. Accordingly, a lot of time and labor are required to complete construction, and it is cumbersome to adhesively bond the structures to each other a large number of times, which may result in a long period of construction.

DISCLOSURE

Technical Problem

Therefore, the present invention has been made in view of the above problems, and it is an object of the present invention to provide a precast concrete staircase construction method of manufacturing two structures formed by vertically dividing a structure of a unit staircase constituting one floor into a left structure and a right structure and enabling construction of the unit staircase by combining the two structures at one time.

Technical Solution

In accordance with the present invention, the above and other objects can be accomplished by the provision of a precast concrete staircase construction method including a mold frame preparation step of forming a square cubic external structure having open upper and lower surfaces and inner surfaces and closed remaining outer surfaces, forming stair landings at an upper surface of one side of the external structure and a central portion of the other side thereof, respectively, forming stair treads between the two stair landings, and preparing a first mold frame and a second mold frame so as to form two structures obtained by vertically dividing a structure of a staircase into a left structure and a right structure, a reinforcing bar arrangement step of assembling and arranging reinforcing bars in the first mold frame and the second mold frame, wherein the reinforcing bar arrangement step is performed after the mold frame preparation step, a concrete pouring and curing step of pouring and curing concrete in each of the first mold frame and the second mold frame, a divided structure manufacturing step of demolding, when curing of the concrete poured into each of the first mold frame and the second mold frame is completed, a first divided structure and a second divided structure from the first mold frame and the second mold frame, respectively, and manufacturing the first divided structure and the second divided structure in a form of vertically dividing the structure of the staircase into the left structure and the right structure, a structure adhesion step of forming the staircase by causing the second divided structure in an upside-down state to adhere to the first divided structure such that open inner surface portions of the first divided structure and the second divided structure adhere to each other to be closed and the two central stair landings are connected to each other to form a plane, and a structure bonding step of completing the staircase by adhesively bonding mutually adhering portions of the first divided structure and the second divided structure.

The divided structure manufacturing step may further include a step of forming a square groove opened in a square shape so that a door is installable on a lower outer surface of the stair landing formed on an upper surface of the first divided structure.

The structure bonding step may further include a step of forming a bonding groove configured to adhesively bond mutually contacting portions of the first divided structure and the second divided structure.

The first mold frame may include a first base disposed on a ground surface, a first front surface molding groove formed to protrude in a plate shape from one side of an upper surface of the first base so as to form a front surface of the first divided structure, wherein the first front surface molding groove has an open upper portion and an empty inner portion, a first rear surface molding groove disposed spaced apart from the first front surface molding groove and formed to protrude in a plate shape from the other side of the upper surface of the first base so as to form a rear surface of the first divided structure, wherein the first rear surface molding groove has an open upper portion and an empty inner portion, a first upper surface stair landing molding groove formed horizontally toward an inner side of the first divided structure at a right angle relative to an end of the first rear surface molding groove so as to form a stair landing on an upper surface of the first divided structure and formed to protrude in a plate shape from the upper surface of the first base so as to communicate with the first rear surface molding groove, wherein the first upper surface stair landing molding groove has an open upper portion and an empty inner portion, a first central stair landing molding groove formed horizontally from an inner central portion of the first front surface molding groove toward the inner side of the first divided structure at a right angle relative to the inner central portion so as to form a stair landing at a central portion of the first divided structure and formed to protrude in a plate shape from the upper surface of the first base so as to communicate with the first front surface molding groove, wherein the first central stair landing molding groove has an open upper portion and an empty inner portion, first stair tread molding grooves formed in a stepped stair shape in a state of being inclined between the first upper surface stair landing molding groove and the first central stair landing molding groove so as to form stair treads of the first divided structure and formed to protrude in a plate shape from the upper surface of the first base so as to communicate with the first upper surface stair landing molding groove and the first central stair landing molding groove, wherein each of the first stair tread molding grooves has an open upper portion and an empty inner portion, a first outer surface molding groove formed in a square plate shape from an upper end of the first front surface molding groove to an upper end of the first rear surface molding groove so as to form an outer surface of the first divided structure, wherein the first outer surface molding groove has an outer circumference protruding upwards and is formed to communicate with the upper ends of the first front surface molding groove and the first rear surface molding groove, and upper ends of the first upper surface stair landing molding groove, the first central stair landing molding groove, and the first stair tread molding grooves, and a square section formed to protrude from the first outer surface molding groove so as to form an open groove located at a lower portion of the first upper surface stair landing molding groove and formed in a part of the first outer surface molding groove. The second molding frame may include a second base disposed on a ground surface, a second front surface molding groove formed to protrude in a plate shape from one side of an upper surface of the second base so as to form a front surface of the second divided structure, wherein the second front surface molding groove has an open upper portion and an empty inner portion, a second rear surface molding groove disposed spaced apart from the second front surface molding groove and formed to protrude in a plate shape from the other side of the upper surface of the second base so as to form a rear surface of the second divided structure, wherein the second rear surface molding groove has an open upper portion and an empty inner portion, a second upper surface stair landing molding groove formed horizontally toward an inner side of the second divided structure at a right angle relative to an end of the second rear surface molding groove so as to form a stair landing on an upper surface of the second divided structure and formed to protrude in a plate shape from the upper surface of the second base so as to communicate with the second rear surface molding groove, wherein the second upper surface stair landing molding groove has an open upper portion and an empty inner portion, a second central stair landing molding groove formed horizontally from an inner central portion of the second front surface molding groove toward an inner side of the second divided structure at a right angle relative to the inner central portion so as to form a stair landing at a central portion of the second divided structure and formed to protrude in a plate shape from the upper surface of the second base so as to communicate with the second front surface molding groove, wherein the second central stair landing molding groove has an open upper portion and an empty inner portion, second stair tread molding grooves formed in a stepped stair shape in a state of being inclined between the second upper surface stair landing molding groove and the second central stair landing molding groove so as to form stair treads of the second divided structure and formed to protrude in a plate shape from the upper surface of the second base so as to communicate with the second upper surface stair landing molding groove and the second central stair landing molding groove, wherein each of the second stair tread molding grooves has an open upper portion and an empty inner portion, and a second outer surface molding groove formed in a square plate shape from an upper end of the second front surface molding groove to an upper end of the second rear surface molding groove so as to form an outer surface of the second divided structure, wherein the second outer surface molding groove has an outer circumference protruding upwards and is formed to communicate with the upper ends of the second front surface molding groove and the second rear surface molding groove, and upper ends of the second upper surface stair landing molding groove, the second central stair landing molding groove, and the second stair tread molding grooves.

Advantageous Effects

As described above, the present invention has the following effects. Since LED light is dispersed with a simple structure, it is possible to solve problems related to an increase in manufacturing costs and deterioration in productivity caused by an anti-glare panel. Further, since a color similar to the LED light is applied to the anti-glare panel, a user may easily distinguish the color of the LED when LED is turned off. Accordingly, sorting of products and handling management thereof become easier. Additionally, installation view is improved during the day when the LED is turned off, thereby having an effect of improving aesthetics.

Furthermore, the present invention manufactures two structures formed by vertically dividing a structure of a unit staircase constituting one floor into a left structure and a right structure, thereby making it possible to construct the unit staircase by combining the two structures at one time. Accordingly, since construction time and manpower are significantly reduced, construction work becomes simplified, and a construction period is significantly shortened.

DESCRIPTION OF DRAWINGS

The above and other objects, features and other advantages of the present invention will be more clearly understood from the following detailed description taken in conjunction with the accompanying drawings, in which.

BEST MODE

Figure 1:
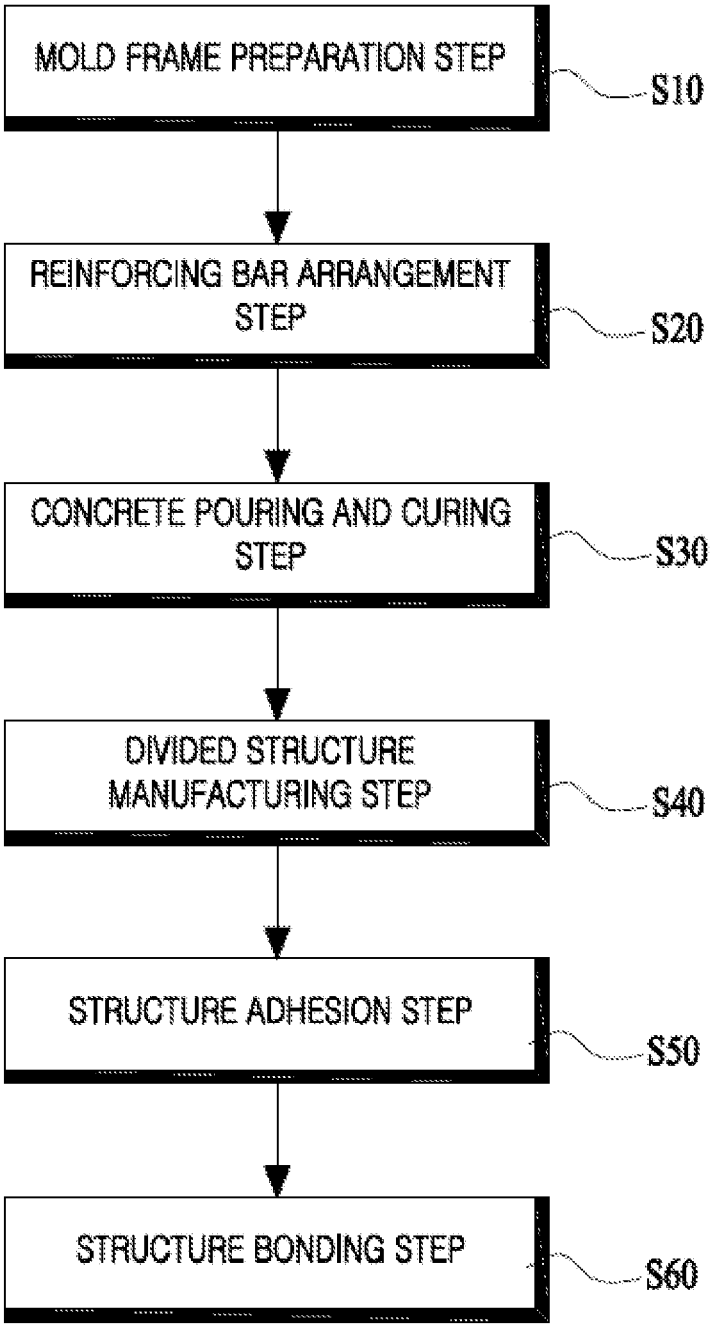
FIG. 1 is a step diagram showing a construction method according to the present invention.

Hereinafter, s preferred embodiment of the present invention will be described in more detail with reference to the accompanying drawings. However, it should be understood that the present invention may be implemented in many different forms and should not be construed as being limited to the embodiments set forth herein.

FIGS. 1 to 7 are drawings showing a construction method according to the present invention. As shown in the drawings, a precast concrete staircase construction method according to the present invention includes a mold frame preparation step (S10) of preparing a first mold frame and a second mold frame, a reinforcing bar arrangement step (S20) of arranging reinforcing bars in the prepared first and second mold frames, a concrete pouring and curing step (S30) of pouring and curing concrete in the first mold frame and the second mold frame, a divided structure manufacturing step (S40) of demolding a first divided structure and a second divided structure from the first mold frame and the second mold frame, respectively, and completing manufacture of the first divided structure and the second divided structure, a structure adhesion step (S50) of causing the first divided structure and the second divided structure to come into close contact with each other, and a structure bonding step (S60) of adhesively bonding the first divided structure and the second divided structure to each other. The above-described steps are sequentially performed, thereby simply and quickly constructing a staircase.

The mold frame preparation step (S10) is a step of forming a square cubic external structure having open upper and lower surfaces and inner surfaces and closed remaining outer surfaces, forming stair landings at an upper surface of one side of the external structure and a central portion of the other side thereof, respectively, forming stair treads between the two stair landings, and preparing a first mold frame and a second mold frame so as to form two structures obtained by vertically dividing a structure of a staircase into a left structure and a right structure. This step is a step of preparing the first mold frame and the second mold frame so as to manufacture the first divided structure and the second divided structure that are formed by vertically dividing the structure of the staircase into the left structure and the right structure (refer to FIGS. 2 and 3).

Figure 8:
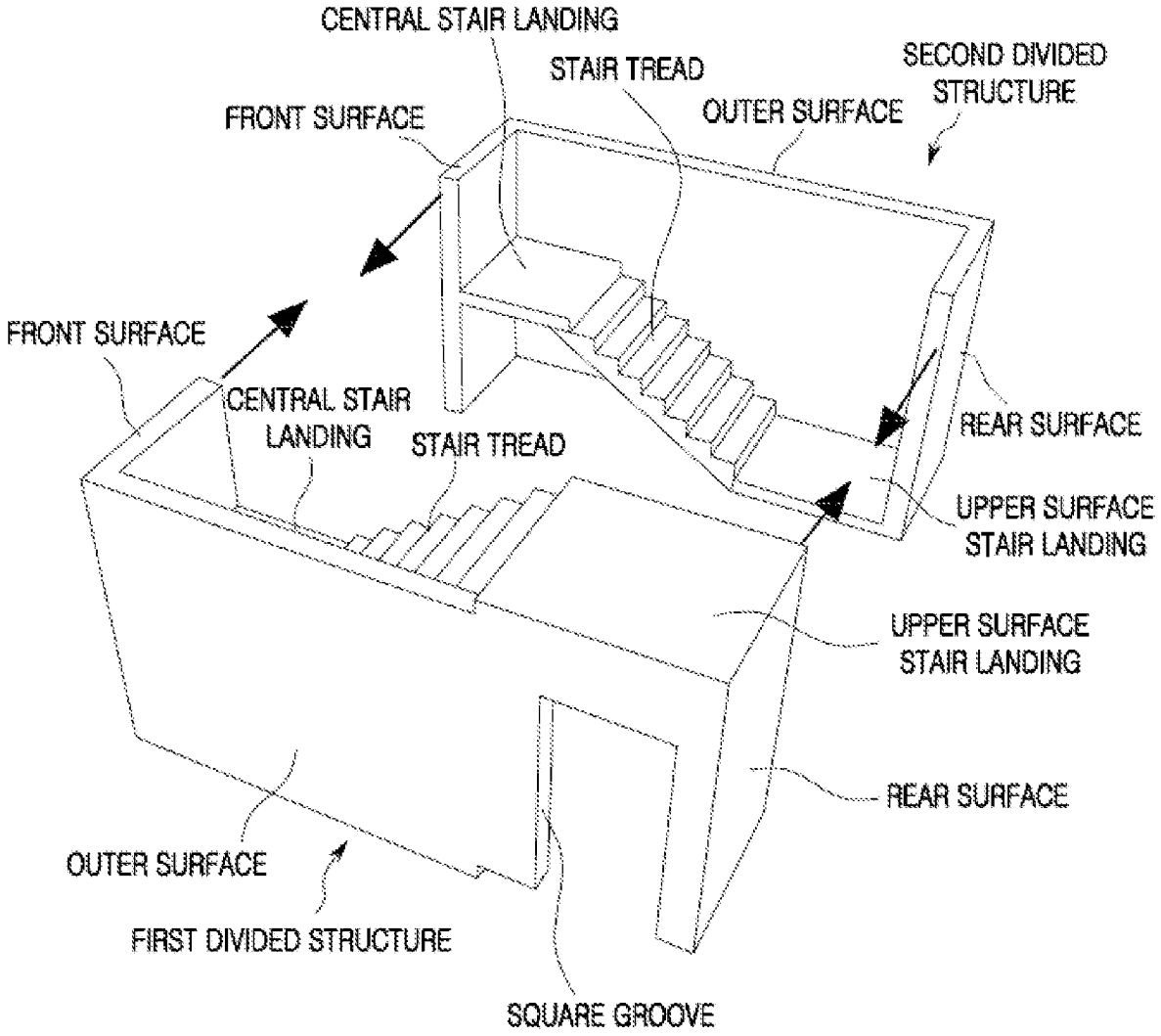
FIG. 8 is a perspective view showing a state in which the first divided structure and the second divided structure are brought into close contact with each other according to the present invention.

Here, the first divided structure has an outer surface formed as a "⊏"-shaped structure between a front surface of the first divided structure and a rear surface thereof, as shown in FIG. 8, and an upper surface stair landing having a flat shape is formed at an upper end of the outer surface and the rear surface. Further, a central stair landing having a flat shape is formed at an inner central portion of the front surface, stair treads are formed between the upper surface stair landing and the central stair landing, and a square groove is formed on the outer surface.

As shown in FIG. 8, the second divided structure has an outer surface formed as a "⊏"-shaped structure between a front surface and a rear surface, and an upper surface stair landing having a flat shape is formed at an upper end of the outer surface and the rear surface. Further, a central stair landing having a flat shape is formed at an inner central portion of the front surface, and stair treads are formed between the upper surface stair landing and the central stair landing. When the second divided structure is combined with the first divided structure, the second divided structure is provided in an upside-down state so that the upper surface stair landing is disposed at a lower portion.

Figure 2:
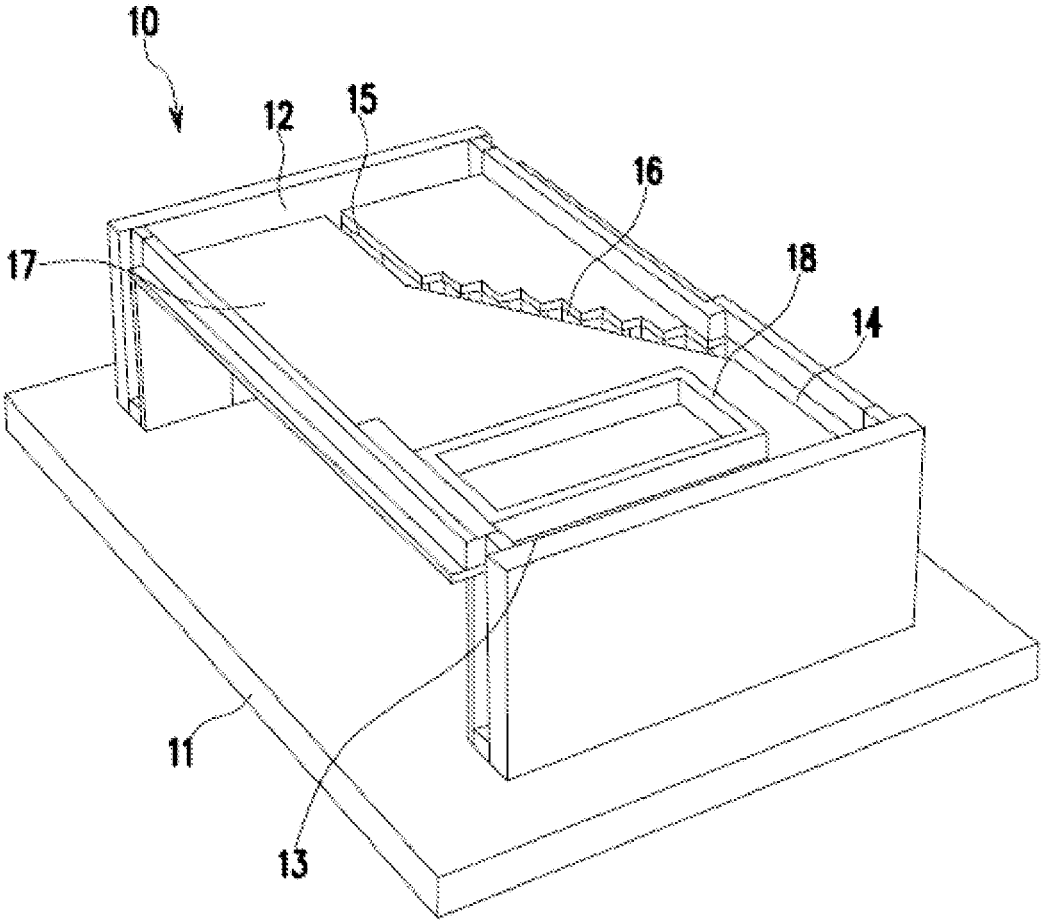
FIG. 2 is a schematic perspective view showing a first mold frame used in the construction method according to the present invention.

Referring to FIGS. 2 and 8, a first mold frame 10 includes a first base 11 disposed on the ground, a first front surface molding groove 12 formed to protrude in a plate shape from one side of an upper surface of the first base 11 so as to form a front surface of the first divided structure, in which the first front surface molding groove 12 has an open upper portion and an empty inner portion, a first rear surface molding groove 13 disposed spaced apart from the first front surface molding groove 12 and formed to protrude in a plate shape from the other side of the upper surface of the first base 11 so as to form a rear surface of the first divided structure, in which the first rear surface molding groove 13 has an open upper portion and an empty inner portion, a first upper surface stair landing molding groove 14 formed horizontally toward an inner side of the first divided structure at a right angle relative to an end of the first rear surface molding groove 13 so as to form a stair landing on an upper surface of the first divided structure and formed to protrude in a plate shape from the upper surface of the first base 11 so as to communicate with the first rear surface molding groove 13, in which the first upper surface stair landing molding groove 14 has an open upper portion and an empty inner portion, a first central stair landing molding groove 15 formed horizontally from an inner central portion of the first front surface molding groove 12 toward the inner side of the first divided structure at a right angle relative to the inner central portion so as to form a stair landing at a central portion of the first divided structure and formed to protrude in a plate shape from the upper surface of the first base 11 so as to communicate with the first front surface molding groove 12, in which the first central stair landing molding groove 15 has an open upper portion and an empty inner portion, first stair tread molding grooves 16 formed in a stepped stair shape in a state of being inclined between the first upper surface stair landing molding groove 14 and the first central stair landing molding groove 15 so as to form stair treads of the first divided structure and formed to protrude in a plate shape from the upper surface of the first base 11 so as to communicate with the first upper surface stair landing molding groove 14 and the first central stair landing molding groove 15, in which each of the first stair tread molding grooves 16 has an open upper portion and an empty inner portion, a first outer surface molding groove 17 formed in a square plate shape from an upper end of the first front surface molding groove 12 to an upper end of the first rear surface molding groove 13 so as to form an outer surface of the first divided structure, in which the first outer surface molding groove 17 has an outer circumference protruding upwards and is formed to communicate with the upper ends of the first front surface molding groove 12 and the first rear surface molding groove 13, and upper ends of the first upper surface stair landing molding groove 14, the first central stair landing molding groove 15, and the first stair tread molding grooves 16, and a square section 18 formed to protrude from the first outer surface molding groove 17 so as to form an open square groove located at a lower portion of the first upper surface stair landing molding groove 14 and formed in a part of the first outer surface molding groove 17.

The first base 11 closes a lower portion of each groove in a state of being supported on the ground and serves to support each groove. The first front surface molding groove 12 serves to mold the front surface of the first divided structure, and the first rear surface molding groove 13 serves to mold the rear surface of the first divided structure.

The first upper surface stair landing molding groove 14 serves to mold the stair landing formed on the upper surface of the first divided structure, and the first central stair landing molding groove 15 serves to mold the stair landing formed at the central portion of the first divided structure.

The first stair tread molding grooves 16 serve to mold the stair treads between the two stair landings. The first outer surface molding groove 17 serves to mold the outer surface of the first divided structure. The first square section 18 serves to mold the square groove formed on the outer surface of the first divided structure.

Figure 3:
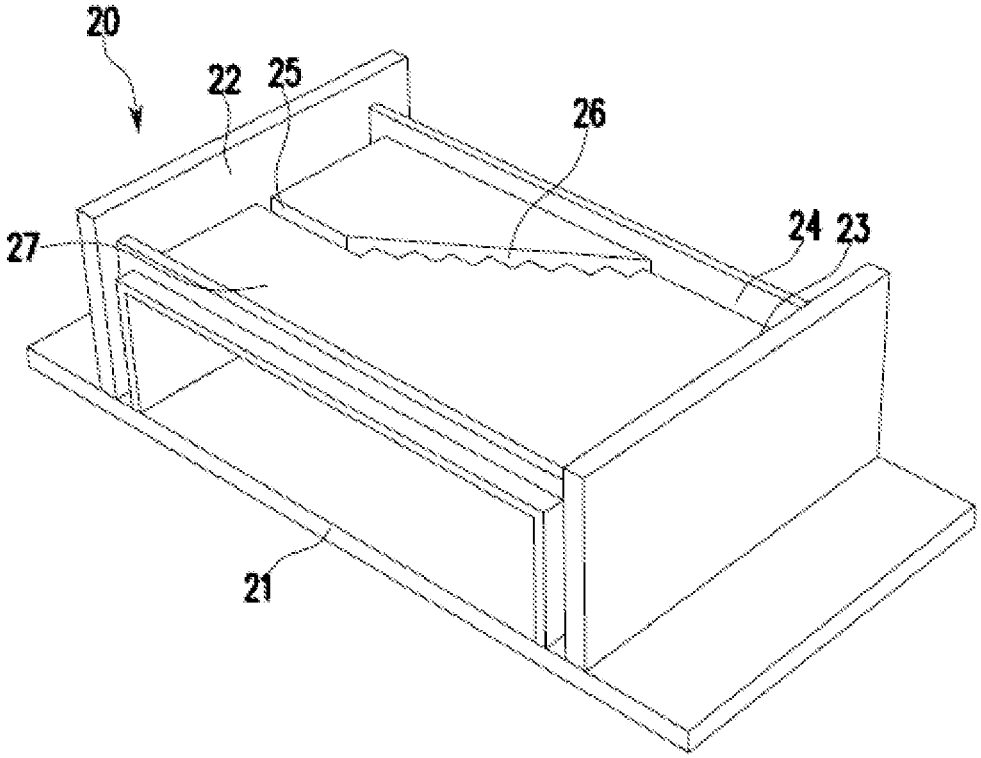
FIG. 3 is a schematic perspective view showing a second mold frame used in the construction method according to the present invention.
Figure 4:
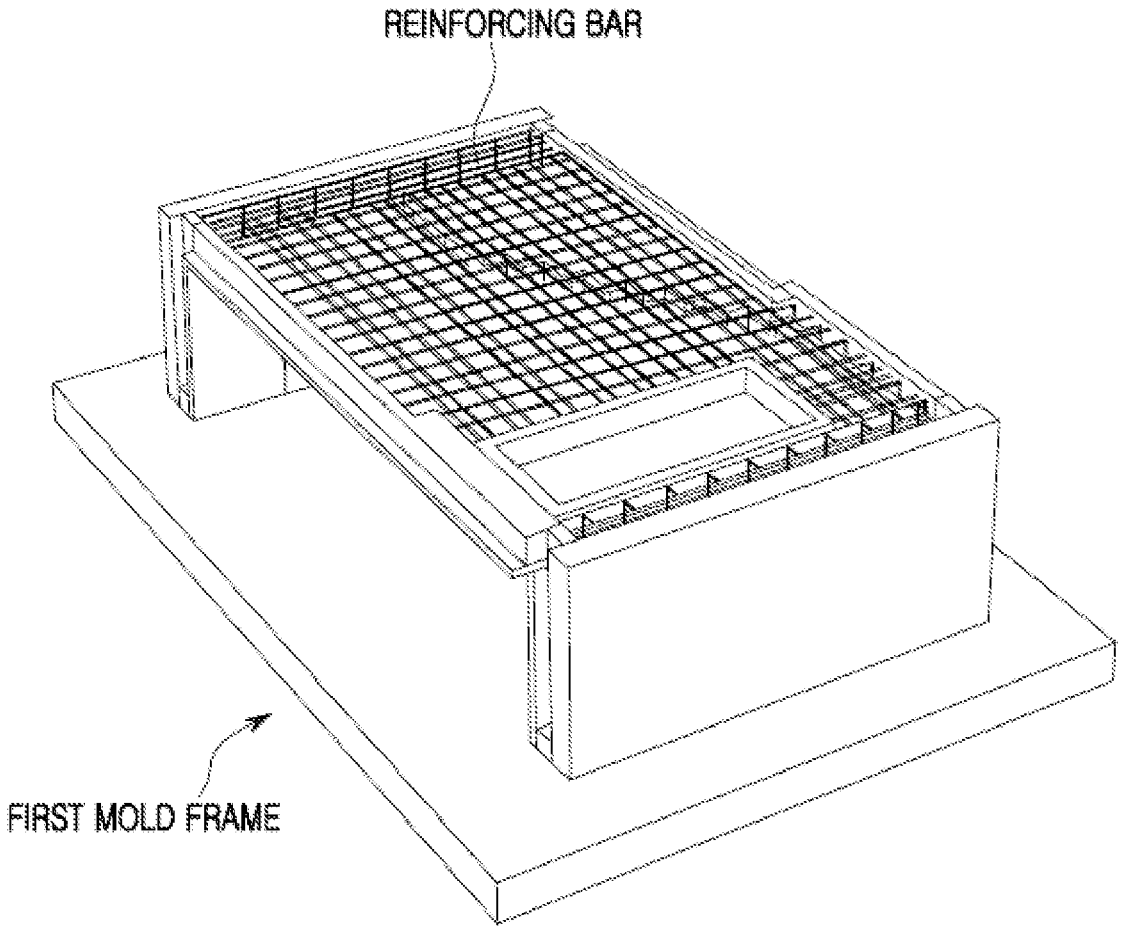
FIG. 4 is a perspective view showing a state in which reinforcing bars are arranged in the mold frame according to the present invention.
Figure 5:
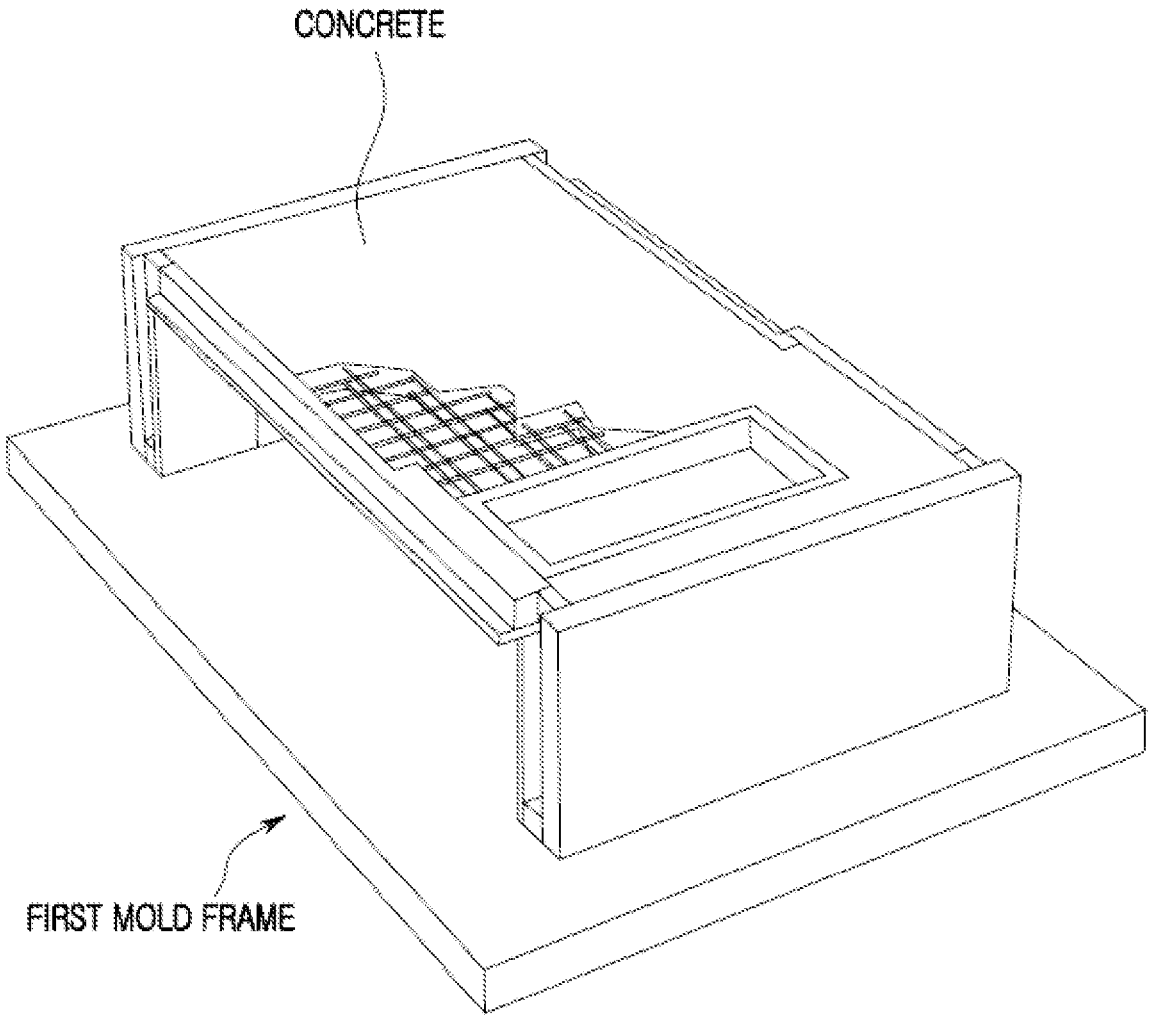
FIG. 5 is a perspective view showing a state in which concrete is poured into the mold frame according to the present invention.
Figure 6:
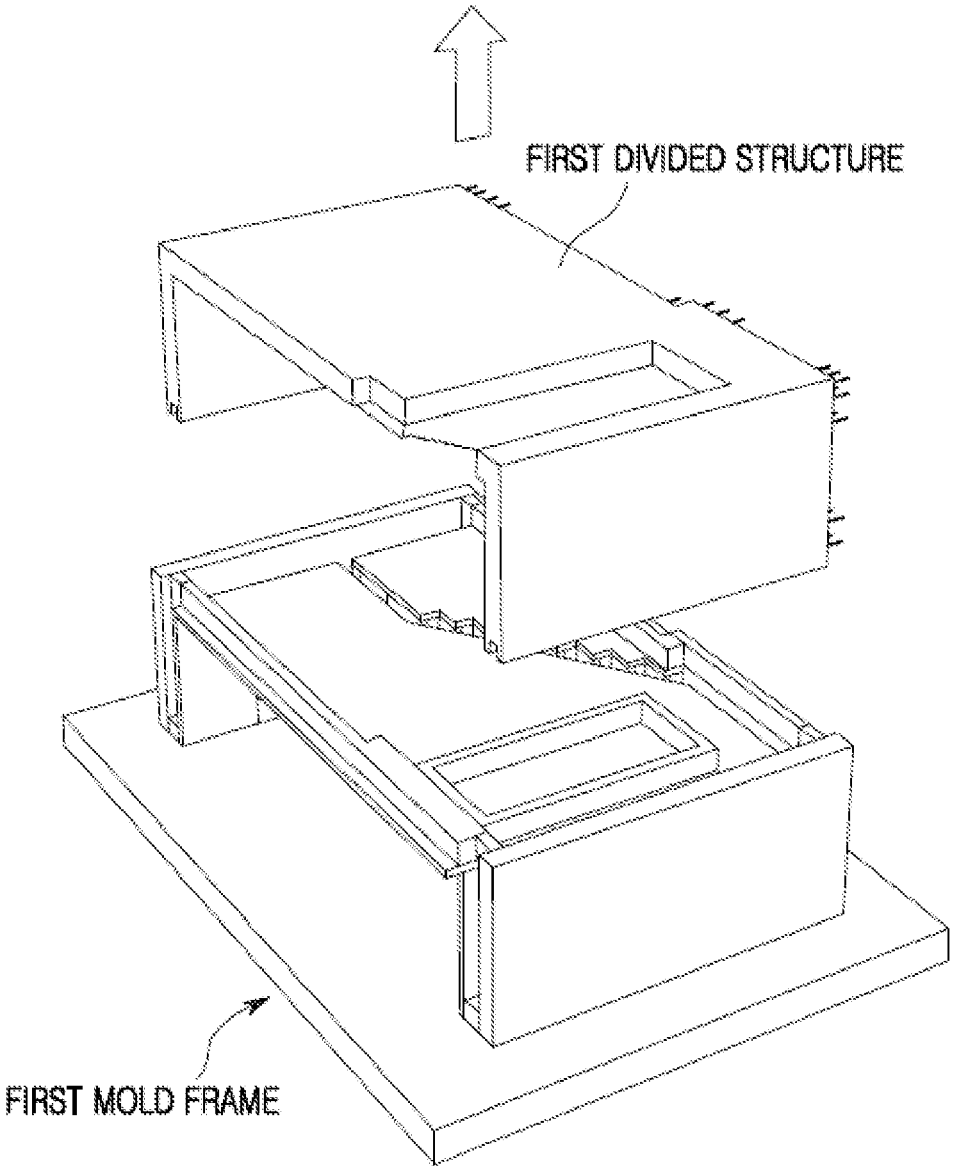
FIG. 6 is a perspective view showing a state in which a first divided structure is demolded from the first mold frame according to the present invention.
Figure 7:
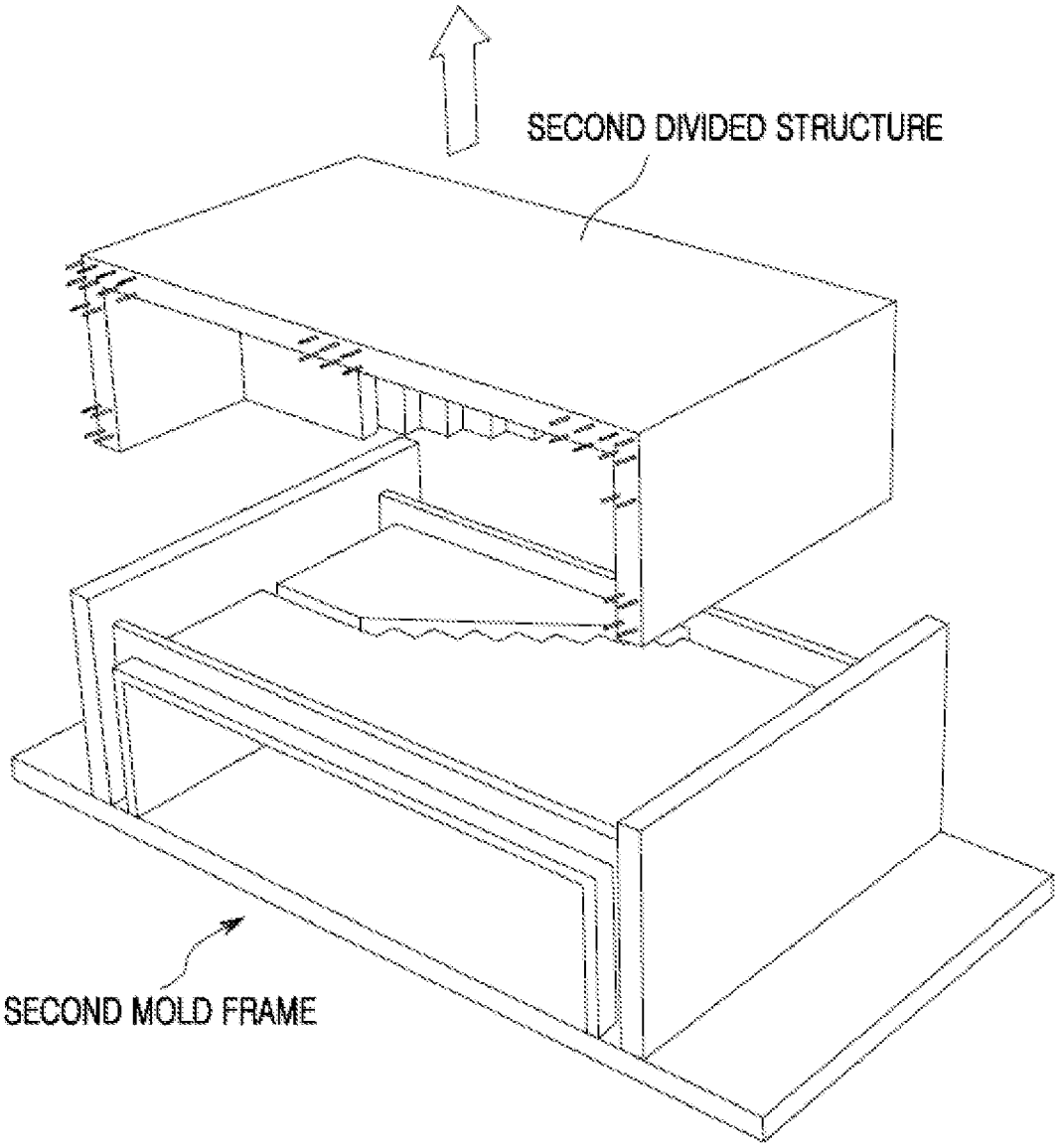
FIG. 7 is a perspective view showing a state in which a second divided structure is demolded from the second mold frame according to the present invention.

Further, referring to FIGS. 3 and 8, a second molding frame 20 includes a second base 21 disposed on the ground, a second front surface molding groove 22 formed to protrude in a plate shape from one side of an upper surface of the second base 21 so as to form a front surface of the second divided structure, in which the second front surface molding groove 22 has an open upper portion and an empty inner portion, a second rear surface molding groove 23 disposed spaced apart from the second front surface molding groove 22 and formed to protrude in a plate shape from the other side of the upper surface of the second base 21 so as to form a rear surface of the second divided structure, in which the second rear surface molding groove 23 has an open upper portion and an empty inner portion, a second upper surface stair landing molding groove 24 formed horizontally toward an inner side of the second divided structure at a right angle relative to an end of the second rear surface molding groove 23 so as to form a stair landing on an upper surface of the second divided structure and formed to protrude in a plate shape from the upper surface of the second base 21 so as to communicate with the second rear surface molding groove 23, in which the second upper surface stair landing molding groove 24 has an open upper portion and an empty inner portion, a second central stair landing molding groove 25 formed horizontally from an inner central portion of the second front surface molding groove 22 toward an inner side of the second divided structure at a right angle relative to the inner central portion so as to form a stair landing at a central portion of the second divided structure and formed to protrude in a plate shape from the upper surface of the second base 21 so as to communicate with the second front surface molding groove 22, in which the second central stair landing molding groove 25 has an open upper portion and an empty inner portion, second stair tread molding grooves 26 formed in a stepped stair shape in a state of being inclined between the second upper surface stair landing molding groove 24 and the second central stair landing molding groove 25 so as to form stair treads of the second divided structure and formed to protrude in a plate shape from the upper surface of the second base 21 so as to communicate with the second upper surface stair landing molding groove 24 and the second central stair landing molding groove 25, in which each of the second stair tread molding grooves 26 has an open upper portion and an empty inner portion, and a second outer surface molding groove 27 formed in a square plate shape from an upper end of the second front surface molding groove 22 to an upper end of the second rear surface molding groove 23 so as to form an outer surface of the second divided structure, in which the second outer surface molding groove 27 has an outer circumference protruding upwards and is formed to communicate with the upper ends of the second front surface molding groove 22 and the second rear surface molding groove 23, and upper ends of the second upper surface stair landing molding groove 24, the second central stair landing molding groove 25, and the second stair tread molding grooves 26.

The second base 21 closes a lower portion of each groove in a state of being supported on the ground and serves to support each groove. The second front surface molding groove 22 serves to mold the front surface of the second divided structure, and the second rear surface molding groove 23 serves to mold the rear surface of the second divided structure.

The second upper surface stair landing molding groove 24 serves to mold the stair landing formed on the upper surface of the second divided structure, and the second central stair landing molding groove 25 serves to form the stair landing formed at the central portion of the second divided structure.

The second stair tread molding grooves 26 serve to mold the stair treads between the two stair landings, and the second outer surface molding groove 27 serves to mold the outer surface of the second divided structure.

The reinforcing bar arrangement step (S20) is a step of assembling and arranging reinforcing bars in the first mold frame and the second mold frame. In this step, the staircase itself formed by arranging the reinforcing bars in the first mold frame and the second mold frame may be formed as a reinforced concrete structure having reinforced durability and rigidity (refer to FIG. 4).

The concrete pouring and curing step (S30) is a step of pouring and curing concrete in the first mold frame and the second mold frame. In this step, in order to mold the first divided structure and the second divided structure into concrete, concrete is poured into each of the first mold frame and the second mold frame, and then the concrete is cured and hardened (refer to FIG. 5).

The divided structure manufacturing step (S40) is a step of demolding, when curing of the concrete poured into each of the first mold frame and the second mold frame is completed, the first divided structure and the second divided structure from the first mold frame and the second mold frame, respectively, and manufacturing the first divided structure and the second divided structure in the form of vertically dividing a structure of a staircase into a left structure and a right structure. This step is executed to complete manufacture of the first divided structure and the second divided structure in the form of vertically dividing the structure of the staircase into the left structure and the right structure (refer to FIGS. 6 and 7).

The divided structure manufacturing step (S40) further includes a step of forming a square groove that is opened in a square shape so that a door is installable on a lower outer surface of the stair landing formed on the upper surface of the first divided structure.

The step of forming the square groove is a step of forming the square groove on the outer surface of one first divided structure and providing an area in which a door used to enter and exit the staircase is installed. The square groove may be manufactured by being provided in the first mold frame or may be formed by allowing an operator to cut the outer surface of the first divided structure. In addition, the square groove may be disposed on a rear surface of the first divided structure in addition to the outer surface of the first divided structure.

The structure adhesion step (S50) is a step of forming the staircase by causing the second divided structure in an upside-down state to adhere to the first divided structure. In this step, open inner surface portions of the first divided structure and the second divided structure adhere to each other and are closed, and the two central stair landings are connected to each other to form a plane (Refer to FIG. 8).

Here, in a state in which the first divided structure is disposed, when the second divided structure is rotated clockwise, and the inner surfaces of the first divided structure and the second divided structure are brought into close contact with each other, the upper surface stair landings are respectively located at the upper portion and the lower portion, and the central stair landings are disposed to form a horizontal plane with each other.

Figure 9:
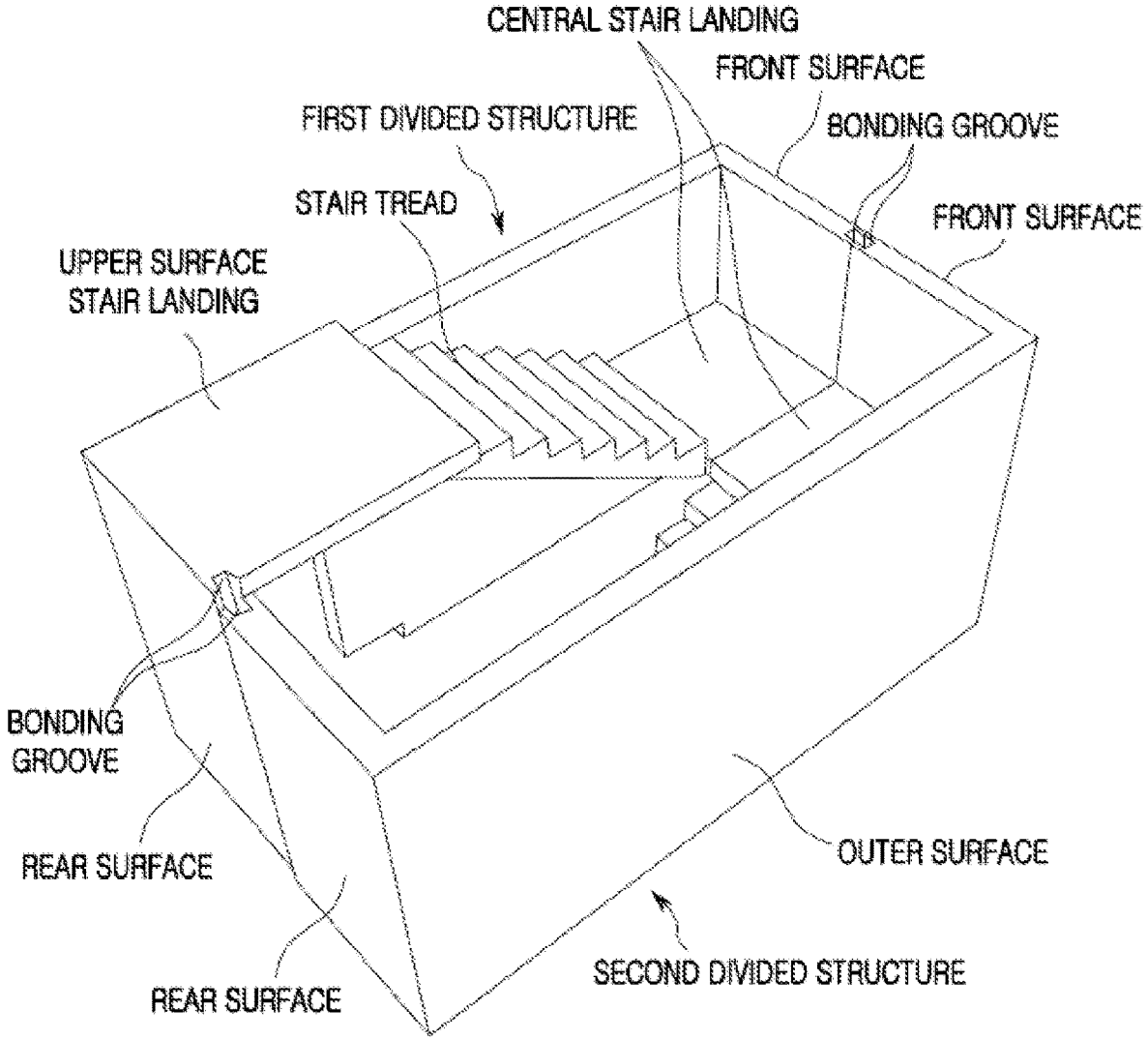
FIG. 9 is a perspective view showing a staircase constructed according to the present invention.

The structure bonding step (S60) is a step of completing the staircase by bonding adhering portions of the first divided structure and the second divided structure to each other (refer to FIG. 9).

As shown in FIG. 9, the structure bonding step further includes a step of forming a bonding groove configured to adhesively bond mutually contacting portions of the first divided structure and the second divided structure. Mortar is injected into the bonding groove so as to firmly bond the two divided structures to each other. Such a bonding groove is manufactured by being provided in a mold frame.

In this manner, the first divided structure and the second divided structure are adhesively bonded to each other, and then the staircases completed as described above are sequentially stacked upwards while bonding portions between the completed staircases are boned to each other, thereby making it possible to easily construct a plurality of staircases.

Although the preferred embodiments of the present invention have been described above, various changes, modifications, and equivalents may be used in the present invention. It is clear that the present invention may be applied in the same manner by appropriately modifying the above-described embodiments. Therefore, the above description does not limit the scope of the present invention, and the true technical protection scope of the present invention should be determined by the technical spirit of the appended claims.

Meanwhile, although specific embodiments have been described above in detail, it will be apparent to those skilled in the art that various modifications are possible without departing from the scope and spirit of the invention as disclosed in the accompanying claims.

The invention claimed is:

1. A precast concrete staircase construction method comprising:

a mold frame preparation step of forming a square cubic external structure, forming an upper surface stair landing at an upper surface of one side of the external structure and a central stair landing at a central portion of another side thereof, forming stair treads between the upper surface stair landing and the central stair landing, and preparing a first mold frame and a second mold frame so as to form a left structure and a right structure;

a reinforcing bar arrangement step of assembling and arranging reinforcing bars in the first mold frame and the second mold frame, wherein the reinforcing bar arrangement step is performed after the mold frame preparation step;

a concrete pouring and curing step of pouring and curing concrete in each of the first mold frame and the second mold frame;

a divided structure manufacturing step of demolding, when curing of the concrete poured into each of the first mold frame and the second mold frame is completed, a first divided structure and a second divided structure from the first mold frame and the second mold frame, respectively, and manufacturing the first divided structure and the second divided structure in a form of vertically dividing the structure of the staircase into the left structure and the right structure;

a structure adhesion step of forming the staircase by causing the second divided structure, which has stairs formed in an opposite direction from stairs of the first divided structure, in an upside-down state to contact the first divided structure such that open inner surface portions of the first divided structure and the second divided structure contact each other to be closed and the central stair landings of the first divided structure and the second divided structure are connected to each other to form a plane; and a structure bonding step of completing the staircase by bonding mutually contacting portions of the first divided structure and the second divided structure.

2. The precast concrete staircase construction method according to claim 1, wherein the divided structure manufacturing step further comprises a step of forming a square groove opened in a square shape so that a door is installable on a lower outer surface of the upper surface stair landing formed on an upper surface of the first divided structure.

3. The precast concrete staircase construction method according to claim 2, wherein the first mold frame comprises:

a first base disposed on a ground surface;

a first front surface molding groove formed to protrude in a plate shape from one side of an upper surface of the first base so as to form a front surface of the first divided structure, wherein the first front surface molding groove has an open upper portion and an empty inner portion;

a first rear surface molding groove disposed spaced apart from the first front surface molding groove and formed to protrude in a plate shape from the other side of the upper surface of the first base so as to form a rear surface of the first divided structure, wherein the first rear surface molding groove has an open upper portion and an empty inner portion;

a first upper surface stair landing molding groove formed horizontally toward an inner side of the first divided structure at a right angle relative to an end of the first rear surface molding groove so as to form a stair landing on an upper surface of the first divided structure and formed to protrude in a plate shape from the upper surface of the first base so as to communicate with the first rear surface molding groove, wherein the first upper surface stair landing molding groove has an open upper portion and an empty inner portion;

a first central stair landing molding groove formed horizontally from an inner central portion of the first front surface molding groove toward the inner side of the first divided structure at a right angle relative to the inner central portion so as to form a stair landing at a central portion of the first divided structure and formed to protrude in a plate shape from the upper surface of the first base so as to communicate with the first front surface molding groove, wherein the first central stair landing molding groove has an open upper portion and an empty inner portion;

first stair tread molding grooves formed in a stepped stair shape in a state of being inclined between the first upper surface stair landing molding groove and the first central stair landing molding groove so as to form stair treads of the first divided structure and formed to protrude in a plate shape from the upper surface of the first base so as to communicate with the first upper surface stair landing molding groove and the first central stair landing molding groove, wherein each of the first stair tread molding grooves has an open upper portion and an empty inner portion;

a first outer surface molding groove formed in a square plate shape from an upper end of the first front surface molding groove to an upper end of the first rear surface molding groove so as to form an outer surface of the first divided structure, wherein the first outer surface molding groove has an outer circumference protruding upwards and is formed to communicate with the upper ends of the first front surface molding groove and the first rear surface molding groove, and upper ends of the first upper surface stair landing molding groove, the first central stair landing molding groove, and the first stair tread molding grooves; and a square section formed to protrude from the first outer surface molding groove so as to form an open groove located at a lower portion of the first upper surface stair landing molding groove and formed in a part of the first outer surface molding groove, and wherein the second molding frame comprises:

a second base disposed on a ground surface;

a second front surface molding groove formed to protrude in a plate shape from one side of an upper surface of the second base so as to form a front surface of the second divided structure, wherein the second front surface molding groove has an open upper portion and an empty inner portion;

a second rear surface molding groove disposed spaced apart from the second front surface molding groove and formed to protrude in a plate shape from the other side of the upper surface of the second base so as to form a rear surface of the second divided structure, wherein the second rear surface molding groove has an open upper portion and an empty inner portion;

a second upper surface stair landing molding groove formed horizontally toward an inner side of the second divided structure at a right angle relative to an end of the second rear surface molding groove so as to form a stair landing on an upper surface of the second divided structure and formed to protrude in a plate shape from the upper surface of the second base so as to communicate with the second rear surface molding groove, wherein the second upper surface stair landing molding groove has an open upper portion and an empty inner portion;

a second central stair landing molding groove formed horizontally from an inner central portion of the second front surface molding groove toward an inner side of the second divided structure at a right angle relative to the inner central portion so as to form a stair landing at a central portion of the second divided structure and formed to protrude in a plate shape from the upper surface of the second base so as to communicate with the second front surface molding groove, wherein the second central stair landing molding groove has an open upper portion and an empty inner portion;

second stair tread molding grooves formed in a stepped stair shape in a state of being inclined between the second upper surface stair landing molding groove and the second central stair landing molding groove so as to form stair treads of the second divided structure and formed to protrude in a plate shape from the upper surface of the second base so as to communicate with the second upper surface stair landing molding groove and the second central stair landing molding groove, wherein each of the second stair tread molding grooves has an open upper portion and an empty inner portion; and a second outer surface molding groove formed in a square plate shape from an upper end of the second front surface molding groove to an upper end of the second rear surface molding groove so as to form an outer surface of the second divided structure, wherein the second outer surface molding groove has an outer circumference protruding upwards and is formed to communicate with the upper ends of the second front surface molding groove and the second rear surface molding groove, and upper ends of the second upper surface stair landing molding groove, the second central stair landing molding groove, and the second stair tread molding grooves.

4. The precast concrete staircase construction method according to claim 1, wherein the structure bonding step further comprises a step of forming a bonding groove configured to bond mutually contacting portions of the first divided structure and the second divided structure.

5. The precast concrete staircase construction method according to claim 1, wherein the first mold frame comprises:

a first base disposed on a ground surface;

a first front surface molding groove formed to protrude in a plate shape from one side of an upper surface of the first base so as to form a front surface of the first divided structure, wherein the first front surface molding groove has an open upper portion and an empty inner portion;

a first rear surface molding groove disposed spaced apart from the first front surface molding groove and formed to protrude in a plate shape from the other side of the upper surface of the first base so as to form a rear surface of the first divided structure, wherein the first rear surface molding groove has an open upper portion and an empty inner portion;

a first upper surface stair landing molding groove formed horizontally toward an inner side of the first divided structure at a right angle relative to an end of the first rear surface molding groove so as to form a stair landing on an upper surface of the first divided structure and formed to protrude in a plate shape from the upper surface of the first base so as to communicate with the first rear surface molding groove, wherein the first upper surface stair landing molding groove has an open upper portion and an empty inner portion;

a first central stair landing molding groove formed horizontally from an inner central portion of the first front surface molding groove toward the inner side of the first divided structure at a right angle relative to the inner central portion so as to form a stair landing at a central portion of the first divided structure and formed to protrude in a plate shape from the upper surface of the first base so as to communicate with the first front surface molding groove, wherein the first central stair landing molding groove has an open upper portion and an empty inner portion;

first stair tread molding grooves formed in a stepped stair shape in a state of being inclined between the first upper surface stair landing molding groove and the first central stair landing molding groove so as to form stair treads of the first divided structure and formed to protrude in a plate shape from the upper surface of the first base so as to communicate with the first upper surface stair landing molding groove and the first central stair landing molding groove, wherein each of the first stair tread molding grooves has an open upper portion and an empty inner portion;

a first outer surface molding groove formed in a square plate shape from an upper end of the first front surface molding groove to an upper end of the first rear surface molding groove so as to form an outer surface of the first divided structure, wherein the first outer surface molding groove has an outer circumference protruding upwards and is formed to communicate with the upper ends of the first front surface molding groove and the first rear surface molding groove, and upper ends of the first upper surface stair landing molding groove, the first central stair landing molding groove, and the first stair tread molding grooves; and a square section formed to protrude from the first outer surface molding groove so as to form an open groove located at a lower portion of the first upper surface stair landing molding groove and formed in a part of the first outer surface molding groove, and wherein the second molding frame comprises:

a second base disposed on a ground surface;

a second front surface molding groove formed to protrude in a plate shape from one side of an upper surface of the second base so as to form a front surface of the second divided structure, wherein the second front surface molding groove has an open upper portion and an empty inner portion;

a second rear surface molding groove disposed spaced apart from the second front surface molding groove and formed to protrude in a plate shape from the other side of the upper surface of the second base so as to form a rear surface of the second divided structure, wherein the second rear surface molding groove has an open upper portion and an empty inner portion;

a second upper surface stair landing molding groove formed horizontally toward an inner side of the second divided structure at a right angle relative to an end of the second rear surface molding groove so as to form a stair landing on an upper surface of the second divided structure and formed to protrude in a plate shape from the upper surface of the second base so as to communicate with the second rear surface molding groove, wherein the second upper surface stair landing molding groove has an open upper portion and an empty inner portion;

a second central stair landing molding groove formed horizontally from an inner central portion of the second front surface molding groove toward an inner side of the second divided structure at a right angle relative to the inner central portion so as to form a stair landing at a central portion of the second divided structure and formed to protrude in a plate shape from the upper surface of the second base so as to communicate with the second front surface molding groove, wherein the second central stair landing molding groove has an open upper portion and an empty inner portion;

second stair tread molding grooves formed in a stepped stair shape in a state of being inclined between the second upper surface stair landing molding groove and the second central stair landing molding groove so as to form stair treads of the second divided structure and formed to protrude in a plate shape from the upper surface of the second base so as to communicate with the second upper surface stair landing molding groove and the second central stair landing molding groove, wherein each of the second stair tread molding grooves has an open upper portion and an empty inner portion; and a second outer surface molding groove formed in a square plate shape from an upper end of the second front surface molding groove to an upper end of the second rear surface molding groove so as to form an outer surface of the second divided structure, wherein the second outer surface molding groove has an outer circumference protruding upwards and is formed to communicate with the upper ends of the second front surface molding groove and the second rear surface molding groove, and upper ends of the second upper surface stair landing molding groove, the second central stair landing molding groove, and the second stair tread molding grooves.

* * * * *